US005536015A

United States Patent [19]

Chen

[11] Patent Number: 5,536,015

[45] Date of Patent: Jul. 16, 1996

[54] CHESS GAME

[76] Inventor: Chin Chen Chen, No. 7, Alley 5, Lane 3, Ryh Shin Road, Dong Shan, Yi Lan County, Taiwan

[21] Appl. No.: 512,162

[22] Filed: Aug. 7, 1995

[51] Int. Cl.[6] ..... A63F 3/02

[52] U.S. Cl. ..... 273/261

[58] Field of Search ..... 273/242, 243, 273/260, 261

[56] References Cited

U.S. PATENT DOCUMENTS

| | | | |
|---|---|---|---|
| D. 231,849 | 6/1974 | Sheck | 273/260 X |
| 1,312,315 | 8/1919 | Emmons | 273/260 |
| 1,492,072 | 4/1924 | Cornell et al. | 273/260 X |
| 2,453,907 | 11/1948 | Hare et al. | 273/260 X |
| 3,825,267 | 7/1974 | Rubinoff | 273/260 |
| 3,929,337 | 12/1975 | Hayes | 273/260 X |
| 4,079,941 | 3/1978 | Morales | 273/260 |
| 4,984,808 | 1/1991 | Young | 273/260 |
| 5,116,062 | 5/1992 | Johnson | 273/260 |

FOREIGN PATENT DOCUMENTS

| | | | |
|---|---|---|---|
| 2191952 | 12/1987 | United Kingdom | 273/260 |

OTHER PUBLICATIONS

"Commander", *Playthings Magazine*, Jun., 1988, p. 75.

*Primary Examiner*—William E. Stoll

*Attorney, Agent, or Firm*—Beveridge, DeGrandi, Weilacher & Young

[57] ABSTRACT

Disclosed is a chess game in which numerals, dollar signs, and a symbolic diamond are combined so that children playing the chess game may learn from the game the meaning of these different numerals, dollar signs, and diamond. The chess game is effected by means of a chess board and a total of thirty-two pieces of chessmen. The chessmen are separately printed with different numerals from 1 to 10, a dollar sign, or a symbolic diamond. The chess game has very simple and plain rules for moving the chessmen and is therefore very suitable for playing by parents with children to establish a pleasant relationship between them during the game.

1 Claim, 5 Drawing Sheets

CHESS GAME

BACKGROUND OF THE INVENTION

Playing chest games is a good entertainment from which people establish pleasant relationships with one another. There are many different chess games, such as "Go" and Chinese Chess. These games are, of course, interesting games; however, they have considerably complicated and profound rules which might prevent the players from enjoying the game, especially when the players are a beginner in respect to the game. To permit both players in a chess game, either young or old in age, parent or child, to enjoy the game and naturally establish a pleasant relationship between them during the game, it is desirable to design a chess game with simple and plain rules specially suitable for an adult and a child to play together.

SUMMARY OF THE INVENTION

The present invention relates to a chess game for two persons, especially for a child and a parent. The game includes sixteen chessmen for each player and a chess board with eighty squares. Among the sixteen chessmen for each player, ten are separately printed at a top surface with one of the numerals from 1 to 10 and with a number of dots equal to the numeral, five are printed with a dollar sign ($), and the remaining one is printed with a symbolic diamond. The eighty squares are so arrayed that there are total of eight longitudinal columns and ten transverse rows and the board is divided into two symmetrical sides for each player. Each of the squares forming the four outer rows of each side is printed with a cross while the two squares at the middle of the first outer row are symmetrically printed with parallel diagonal lines.

DETAILED DESCRIPTION OF THE PREFERRED EMBODIMENT

Figure 1:
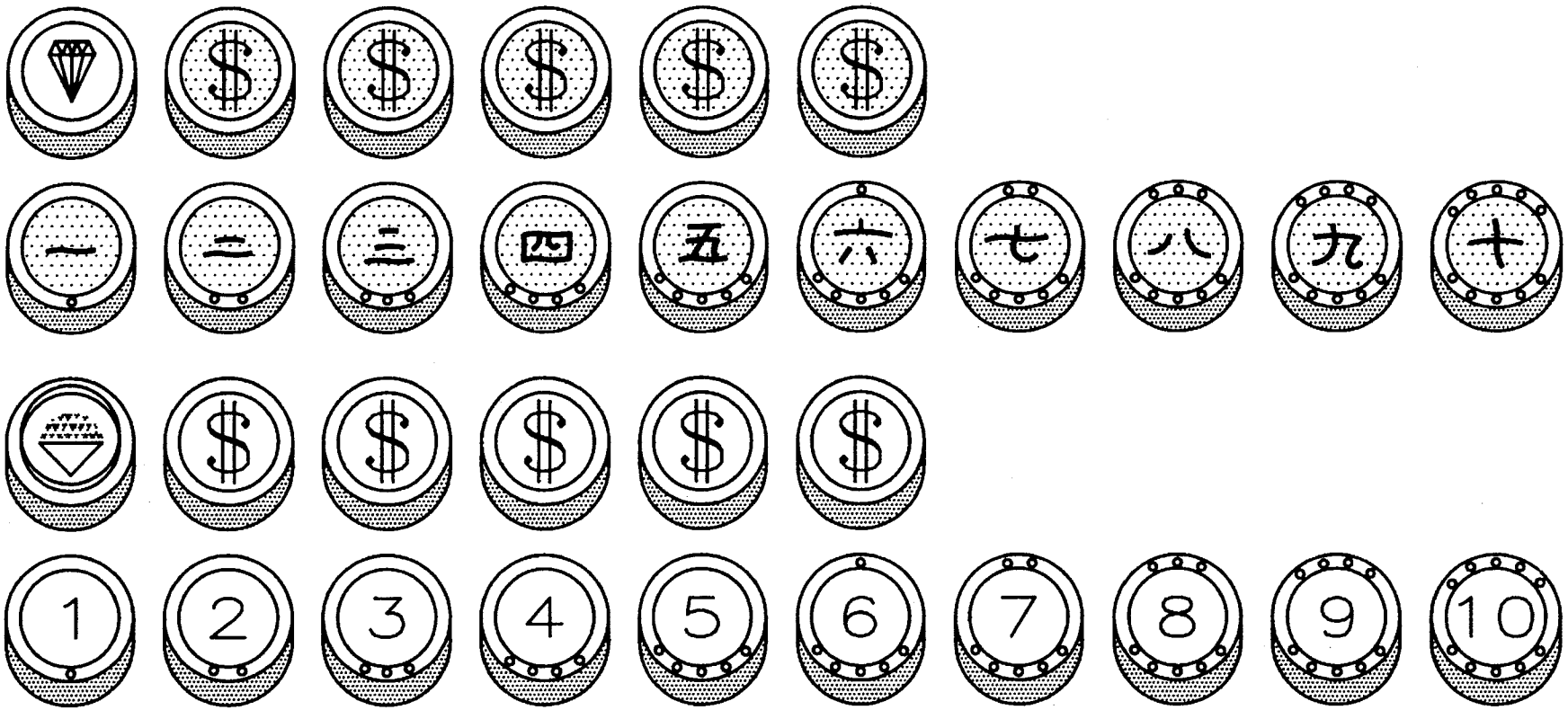
FIG. 1 illustrates the chessmen of the chess game according to the present invention.

Please refer to FIG. 1. The chess game provided by the present invention is suitable for two players. There are sixteen chessmen for each player. Among the sixteen chessmen, ten are numeral ("figure") chessmen which are separately printed on a top surface with one of the numerals from 1 to 10, five are dollar sign ("$") chessmen which are separately printed on a top surface with a dollar sign, and one is the "diamond" chessman which is printed on a top surface with a symbolic diamond.

Figure 2:
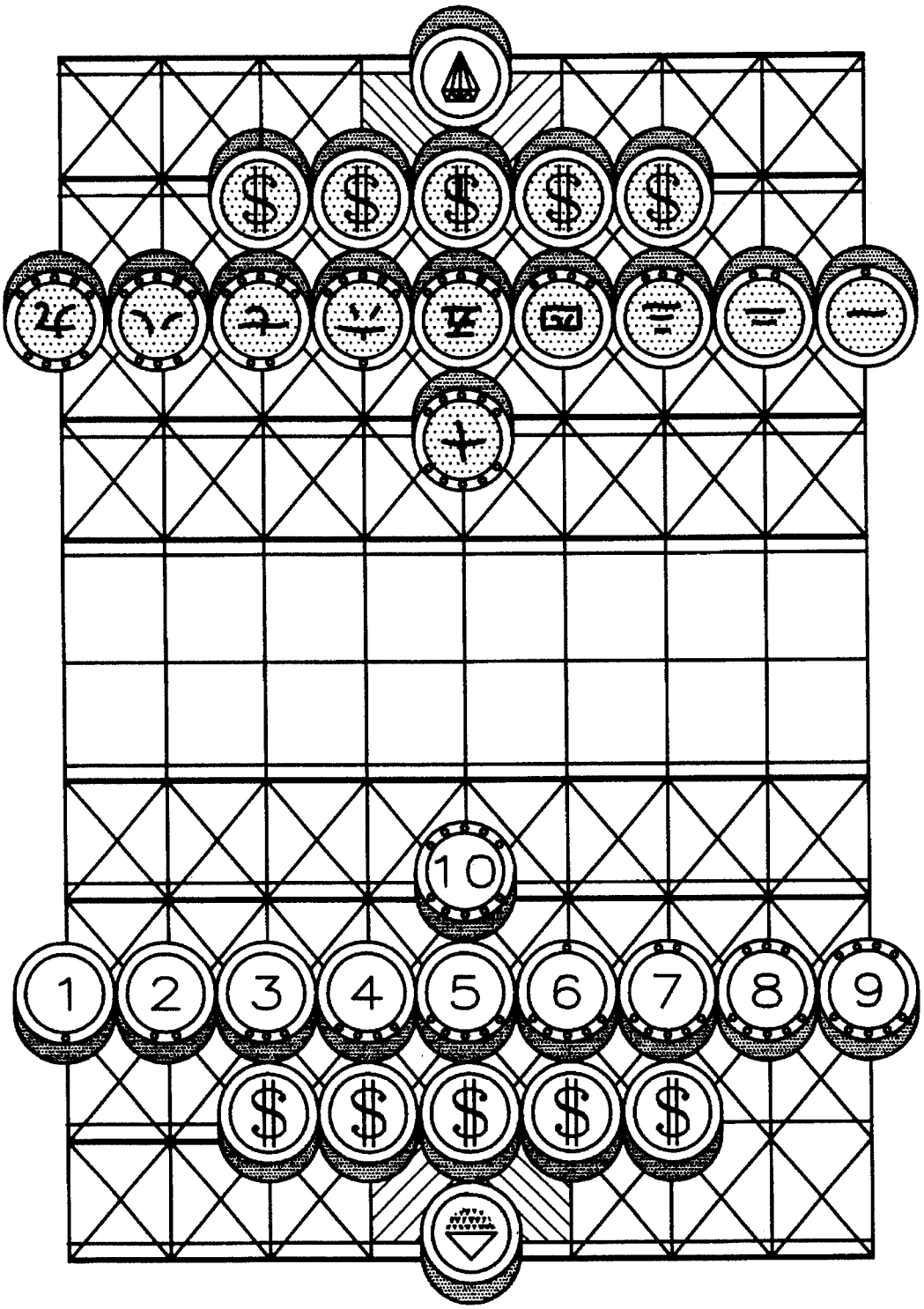
FIG. 2 illustrates the chess board and the initial position of each chessman on the chess board of the chess game according to the present invention.

Please refer to FIG. 2. The chess game of the present invention is played on a chess board on which a total of eight longitudinal columns and ten transverse rows are formed and delimited by nine longitudinal lines and eleven transverse lines, so that total eighty squares are formed thereon. The eighty squares are divided into two sides. Squares of the four outer rows at each side are printed with a cross while the two middle squares at the first outer row of each side are symmetrically printed with parallel diagonal lines. The numeral chessman printed with numeral "10" is placed at the intersection of the middle longitudinal line with the fourth transverse line, the numeral chessmen with numerals 1 to 9 are sequentially placed from left to right at the intersections of the third transverse line with the longitudinal lines. The dollar sign ("$") chessmen are placed at the intersections of the second transverse line with the longitudinal lines. The "diamond" chessman is the "King" and is placed at the intersection of the middle longitudinal line with the first transverse line.

Figure 3:
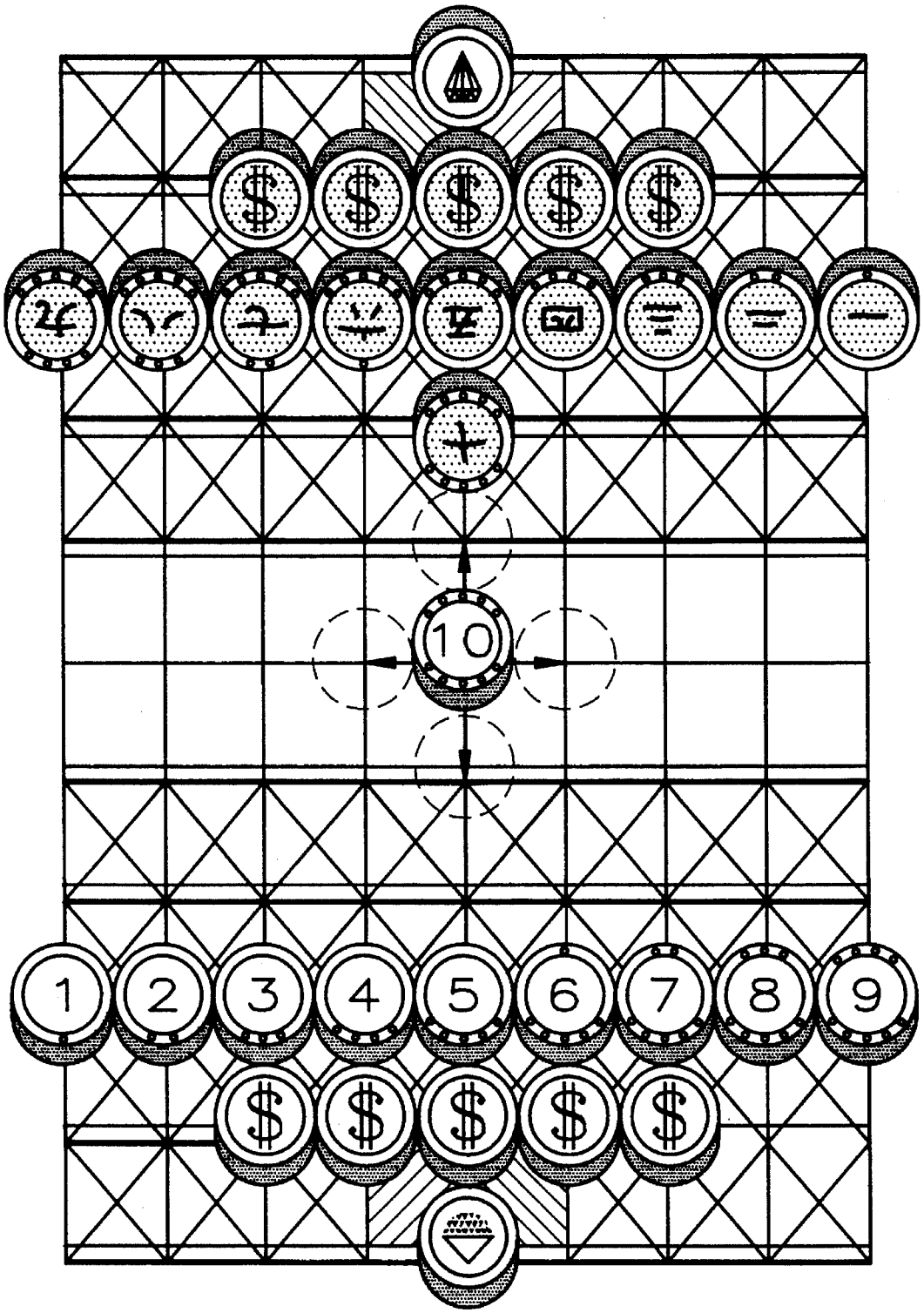
FIG. 3 exemplifies the rules for moving the numeral ("figure") chessmen of the chess game of the present invention.

Please refer to FIG. 3 which illustrates the rules of moving the numeral chessmen. From the drawing, it can be seen that the numeral chessman each can be moved one single straight step each time in any direction, that is, be moved forward, backward, rightward, or leftward. A numeral chessman having a bigger number shall take an opposing chessman having a smaller number, and numeral chessmen of the two sides having the same number may take each other.

Figure 4:
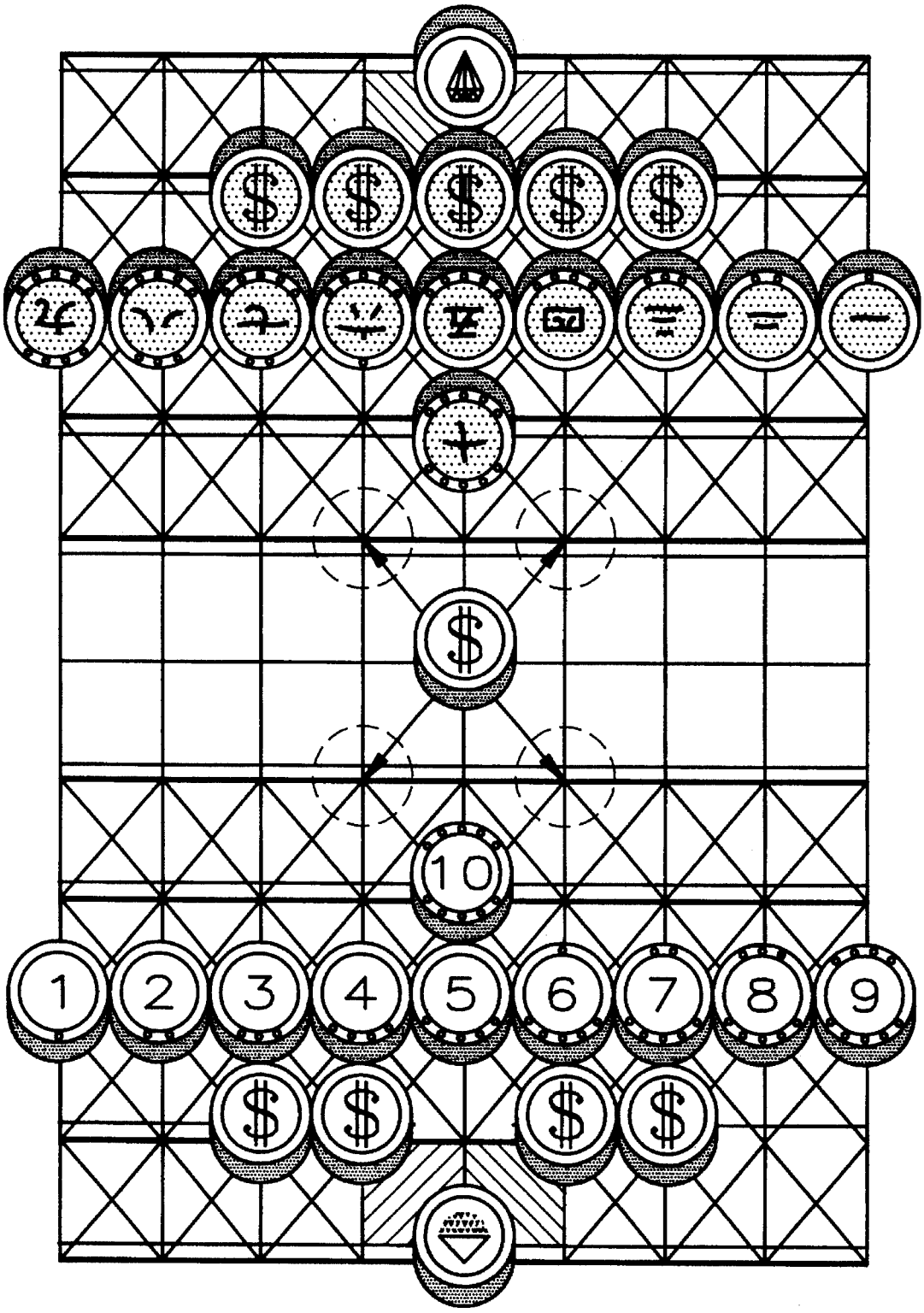
FIG. 4 exemplifies the rules for moving the dollar sign ("$") chessmen of the chess game of the present invention.

Please refer to FIG. 4 which illustrates the rules of moving the dollar sign ("$") chessmen. From the drawing, it can be seen that the dollar sign ("$") chessman each can be moved one single diagonal step each time in any direction. The dollar sign ("$") chessman can take any other opposing chessman and may be taken by any other opposing chessman.

Figure 5:
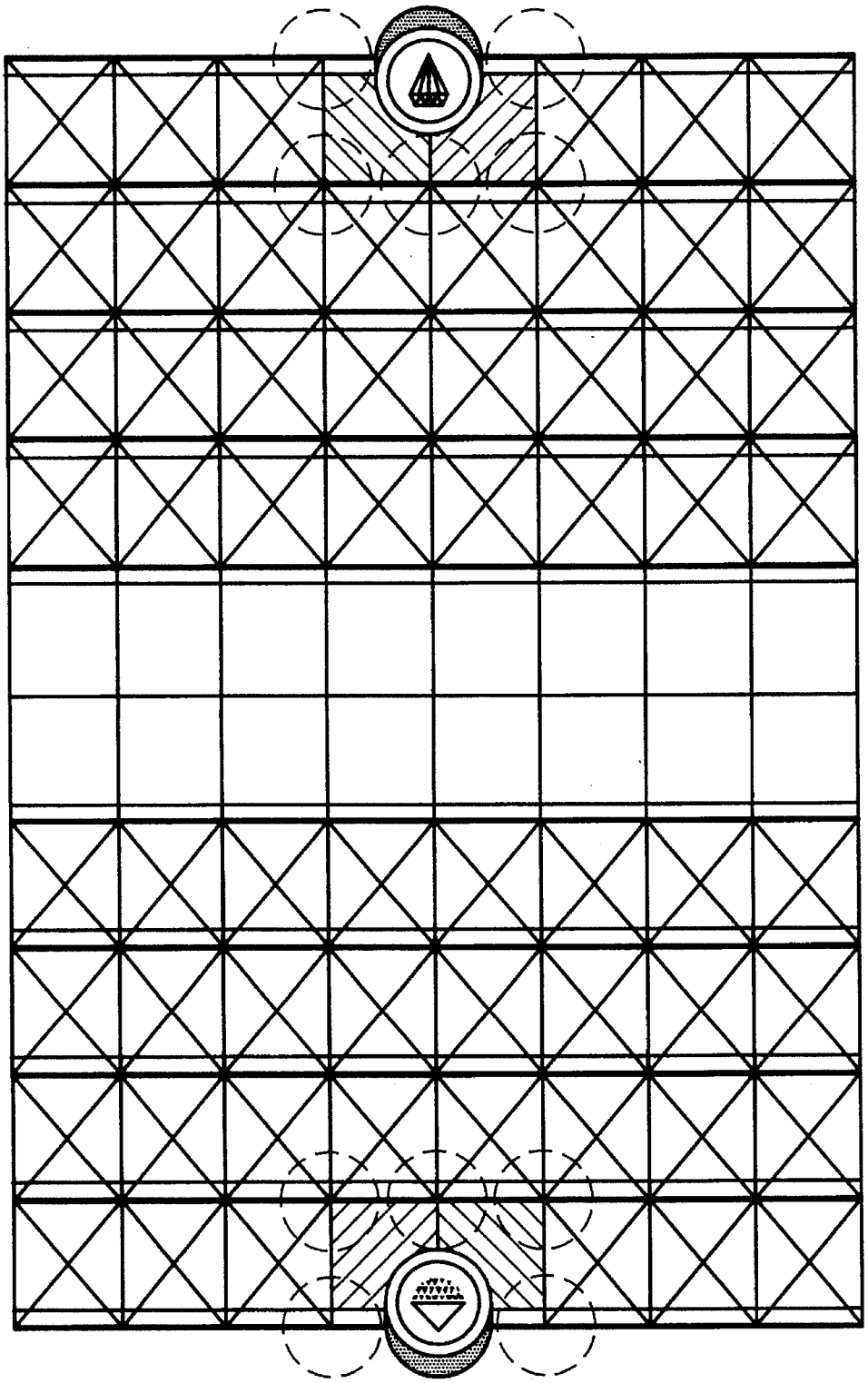
FIG. 5 exemplifies the rules for moving the "diamond" chessmen of the chess game of the present invention.

FIG. 5 illustrates the rules of moving the "diamond" chessman. From the drawing, it can be seen that the "diamond" chessman can be moved around only within an area defined by the first and the second transverse lines and the fourth and the sixth longitudinal lines, that is, the two squares with symmetrically parallel diagonal lines. The "diamond" chessman can take any other opposing chessman moving into a place directly adjacent to it. The side whose "diamond" chessman is taken by the other opposing chessman is considered losing the game.

What is claimed is:

1. A chess game comprising:

a chess board on which a total of eighty squares are formed from and delimited by nine longitudinal lines intersected with eleven transverse lines, such that there are a total of eight columns and ten rows of squares on said chess board, said eighty squares being divided into two sides of five rows, said squares that are located at four outer rows of each of said two sides being printed with an X except for two of said squares centered at a first outer row of each of said two sides being symmetrically printed with parallel diagonal lines;

ten numeral chessmen for each side, each being printed on a top surface with one of the numerals from 1 to 10 and dots in the number equal to said numeral on a respective chessman, said numeral chessman with numeral 10 being placed at an intersection of a middle longitudinal line with a fourth transverse line, said numeral chessmen with numerals 1 to 9 being sequentially placed from left to right at intersections of a third transverse line with said longitudinal lines, wherein said numeral chessman each can be moved forward, backward, rightward, or leftward one single straight step each time, and any of said numeral chessman having a bigger numeral shall take an opposing chessman having a smaller numeral, and any of said numeral chessmen of said two sides having the same numeral may take each other;

five dollar sign chessmen for each side, each being printed on a top surface with a dollar sign and being placed at intersections of a second transverse line with said longitudinal lines, wherein said dollar sign chessmen each can be moved one single diagonal step each time in any direction and can take any other opposing chessman and may be taken by any other opposing chessman; and a diamond chessman for each side, being printed on a top surface with a symbolic diamond and being placed at an intersection of said middle longitudinal line with a first transverse line, wherein said diamond chessman can be moved around only within an area defined by said first and said second transverse lines and a fourth and a sixth longitudinal lines, and said diamond chessman can take any other opposing chessman moving into a place directly adjacent to it, and wherein a side whose diamond chessman is taken by the other opposing chessman is considered losing the game.

* * * * *